US008469680B2

(12) United States Patent
Murata et al.

(10) Patent No.: US 8,469,680 B2
(45) Date of Patent: Jun. 25, 2013

(54) VALVE BODY FOR PUMPS

(75) Inventors: Minoru Murata, Tokyo (JP); Shigeru Murata, Tokyo (JP)

(73) Assignee: Yamada Corporation (JP)

( * ) Notice: Subject to any disclaimer, the term of this patent is extended or adjusted under 35 U.S.C. 154(b) by 430 days.

(21) Appl. No.: 12/704,625

(22) Filed: Feb. 12, 2010

(65) Prior Publication Data

US 2011/0135522 A1 Jun. 9, 2011

(30) Foreign Application Priority Data

Dec. 3, 2009 (JP) ..... 2009-275371

(51) Int. Cl.
*F04B 17/00* (2006.01)
*F04B 35/00* (2006.01)

(52) U.S. Cl.
USPC ..... 417/392; 417/394; 417/395; 91/350; 91/348

(58) Field of Classification Search
USPC ..... 417/392, 394, 395; 92/350, 348, 92/329, 344
See application file for complete search history.

(56) References Cited

U.S. PATENT DOCUMENTS 2,781,728 A * 2/1957 Fischer et al. ..... 417/86
3,652,187 A * 3/1972 Loeffler et al. ..... 417/393
4,646,786 A * 3/1987 Herder et al. ..... 137/625.69
5,368,452 A 11/1994 Johnson et al.
5,664,940 A 9/1997 Du
5,860,794 A 1/1999 Hand et al.
5,927,954 A 7/1999 Kennedy et al.
6,158,982 A 12/2000 Kennedy et al.

FOREIGN PATENT DOCUMENTS

JP 60-104785 A 6/1985

OTHER PUBLICATIONS

Extended European Search Report for European Application No.: 10186944.4—2315 dated Apr. 6, 2011.
Partial European Search Report for application No. 10186944.4-2315 dated Feb. 4, 2011.
Office Action for Japanese Application No. 2009-275371, mailed Nov. 1, 2011, with English translation.

* cited by examiner

*Primary Examiner* — Charles Freay
*Assistant Examiner* — Ryan Gatzemeyer
(74) *Attorney, Agent, or Firm* — Cantor Colburn LLP

(57) ABSTRACT

A valve body for pumps has a compressed air-filled chamber in the center thereof and a compressed air supply port through which compressed air is supplied into the compressed air-filled chamber. The outer surface of the valve body is provided with an annular groove-shaped air supply chamber that communicates between the compressed air-filled chamber and a pump-side air chamber. Compressed air supplied into the compressed air-filled chamber through the compressed air supply port is supplied into the pump-side air chamber through the air supply chamber.

6 Claims, 10 Drawing Sheets

VALVE BODY FOR PUMPS

BACKGROUND OF THE INVENTION

1. Field of the Invention

The present invention relates to a valve body usable in various pumps such as diaphragm pumps and piston pumps.

2. Technical Field of the Invention

There have heretofore been known valves usable in various pumps such as diaphragm pumps and piston pumps (for example, see U.S. Pat. Nos. 5,664,940, 6,158,982, 5,927,954, 5,860,794 and 5,368,452).

In general, a diaphragm pump is operated by using compressed air supplied through a valve as a drive source. As is well known, two diaphragms disposed in bilateral symmetry are provided on the opposite ends, respectively, of a center shaft reciprocatable in the axial direction, and air chambers defined inside the respective diaphragms are periodically supplied with compressed air through a valve, thereby repeating the push-pull operation of the pair of diaphragms to perform a pumping action.

FIG. 10 shows schematically a conventional pump valve usable in a double diaphragm pump. As shown in FIG. 10, the pump valve has a valve body 51 having a compressed air-filled chamber 50 formed in the center thereof, and a center shaft 52 reciprocatably extends through the compressed air-filled chamber 50 of the valve body 51. The center shaft 52 extends through air chamber blocks 53 disposed at the opposite sides of the valve body 51 to define air chambers. Diaphragms (not shown) are secured to the opposite ends, respectively, of the center shaft 52. The compressed air-filled chamber 50 of the valve body 51 is provided therein with a switching member 54 attached to the center shaft 52.

The valve body 51 is provided with a piping block 55. The piping block 55 is formed with two air supply passages 56 and 57 through which compressed air supplied into the compressed air-filled chamber 50 of the valve body 51 from a compressed air supply port (not shown) is supplied into the air chambers, respectively, and also formed with an air release passage 58 through which the compressed air supplied into the compressed air-filled chamber 50 is released into the atmosphere. A slide member 59 associated with the passages 56, 57 and 58 is disposed in the compressed air-filled chamber 50 in engagement with the switching member 54.

In the state shown in FIG. 10, the slide member 59 is in a position where it communicates the air supply passage 57 with the air release passage 58 and also communicates the air supply passage 56 with the compressed air-filled chamber 50. The compressed air in the air chamber disposed at the left-hand side as seen in the figure is discharged into the atmosphere through the air supply passage 57 and the air release passage 58. When, in this state, compressed air is supplied into the compressed air-filled chamber 50 of the valve body 51 from the compressed air supply port (not shown), the compressed air passes through the air supply passage 56 and is supplied into the air chamber disposed at the right-hand side in the figure. In response to the compressed air thus supplied, the diaphragm (not shown) disposed at the right-hand side in the figure is moved rightward, causing the center shaft 52 to move rightward. The movement of the center shaft 52 causes the slide member 59 to move rightward together with the center shaft 52, thereby allowing communication between the air supply passage 56 and the air release passage 58. As a result, the compressed air in the air chamber disposed at the right-hand side in the figure is discharged into the atmosphere through the air supply passage 56 and the air release passage 58. At the same time, the slide member 59 allows the air supply passage 57 to communicate with the compressed air-filled chamber 50. In this state, compressed air supplied into the compressed air-filled chamber 50 of the valve body 51 from the compressed air supply port (not shown) passes through the air supply passage 57 and is supplied into the air chamber disposed at the left-hand side in the figure. In response to the compressed air thus supplied, the diaphragm disposed at the left-hand side in the figure is moved leftward, causing the center shaft 52 to move leftward together with the slide member 59. This operation is repeated to perform a pumping action.

In the conventional pump valve as shown in FIG. 10, however, the air supply passages 56 and 57 are formed in the piping block 55 so that the air chamber-side ends of the air supply passages 56 and 57 align with the corresponding through-holes in the air chamber blocks 53 defining the air chambers. In other words, the through-holes of the air chamber blocks 53 have to be formed so as to align with the air chamber-side ends of the air supply passages 56 and 57, respectively. In addition, when installed, the air chamber blocks 53 have to be mounted so that their through-holes align with the air chamber-side ends of the air supply passages 56 and 57, respectively.

SUMMARY OF THE INVENTION

The present invention has been made in view of the above-described problems associated with the related background art. Accordingly, an object of the present invention is to provide a valve body for pumps in which large air supply chambers are formed in side walls of the valve body that correspond to air chamber blocks, respectively, to increase the degree of freedom in forming air supply passages and in forming through-holes in the air chamber blocks and also to increase the ease of installation of the air chamber blocks, thereby allowing reductions in the number of component parts and in the number of assembling steps and also a reduction in the overall size of a pump to which the valve body is applied.

The present invention provides a valve body for pumps that includes a compressed air-filled chamber in the center of the valve body, a compressed air supply port through which compressed air is supplied into the compressed air-filled chamber, and an annular groove-shaped air supply chamber formed on the outer surface of the valve body. The air supply chamber communicates between the compressed air-filled chamber and a pump-side air chamber. In the valve body, compressed air supplied into the compressed air-filled chamber through the compressed air supply port is supplied into the pump-side air chamber through the air supply chamber.

In addition, the present invention provides a valve body for pumps that includes a compressed air-filled chamber in the center of the valve body, a compressed air supply port through which compressed air is supplied into the compressed air-filled chamber, a first side wall joined to a first air chamber block that defines a first air chamber and that has at least one first through-hole, a first communication passage communicating between the compressed air-filled chamber and the first side wall, a second side wall joined to a second air chamber block that defines a second air chamber and that has at least one second through-hole, and a second communication passage communicating between the compressed air-filled chamber and the second side wall. The valve body further includes an annular groove-shaped first air supply chamber formed in the first side wall. The first communication passage and the at least one first through-hole are communicated with each other through the annular groove-shaped first air supply chamber. Further, the valve body includes an annular groove-shaped second air supply chamber formed in the second side wall. The second communication passage and the at least one second through-hole are communicated with each other through the annular groove-shaped second air supply chamber.

The first air supply chamber and the second air supply chamber may be formed in substantially the same annular groove shape. The first communication passage and the second communication passage may each comprise a plurality of communication passages.

The valve body for pumps may be applied, for example, to a double diaphragm pump or a piston pump.

The valve body for pumps according to the present invention has a compressed air-filled chamber in the center of the valve body and a compressed air supply port through which compressed air is supplied into the compressed air-filled chamber. The outer surface of the valve body is provided with an annular groove-shaped air supply chamber that communicates between the compressed air-filled chamber and a pump-side air chamber. In the valve body, compressed air supplied into the compressed air-filled chamber through the compressed air supply port is supplied into the pump-side air chamber through the air supply chamber. Accordingly, the large air supply chamber formed on the outer surface of the valve body makes it possible to increase the degree of freedom in forming communication passages and in forming through-holes in air chamber blocks and also to increase the ease of installation of the air chamber blocks, thereby allowing reductions in the number of component parts and in the number of assembling steps and also a reduction in the overall size of a pump to which the valve body is applied, and yet enabling the pump capacity to be increased. In addition, the communication passages can be shortened to reduce the resistance as compared with the air supply passages in the conventional valve body for pumps.

DETAILED DESCRIPTION OF THE INVENTION

Figure 1:
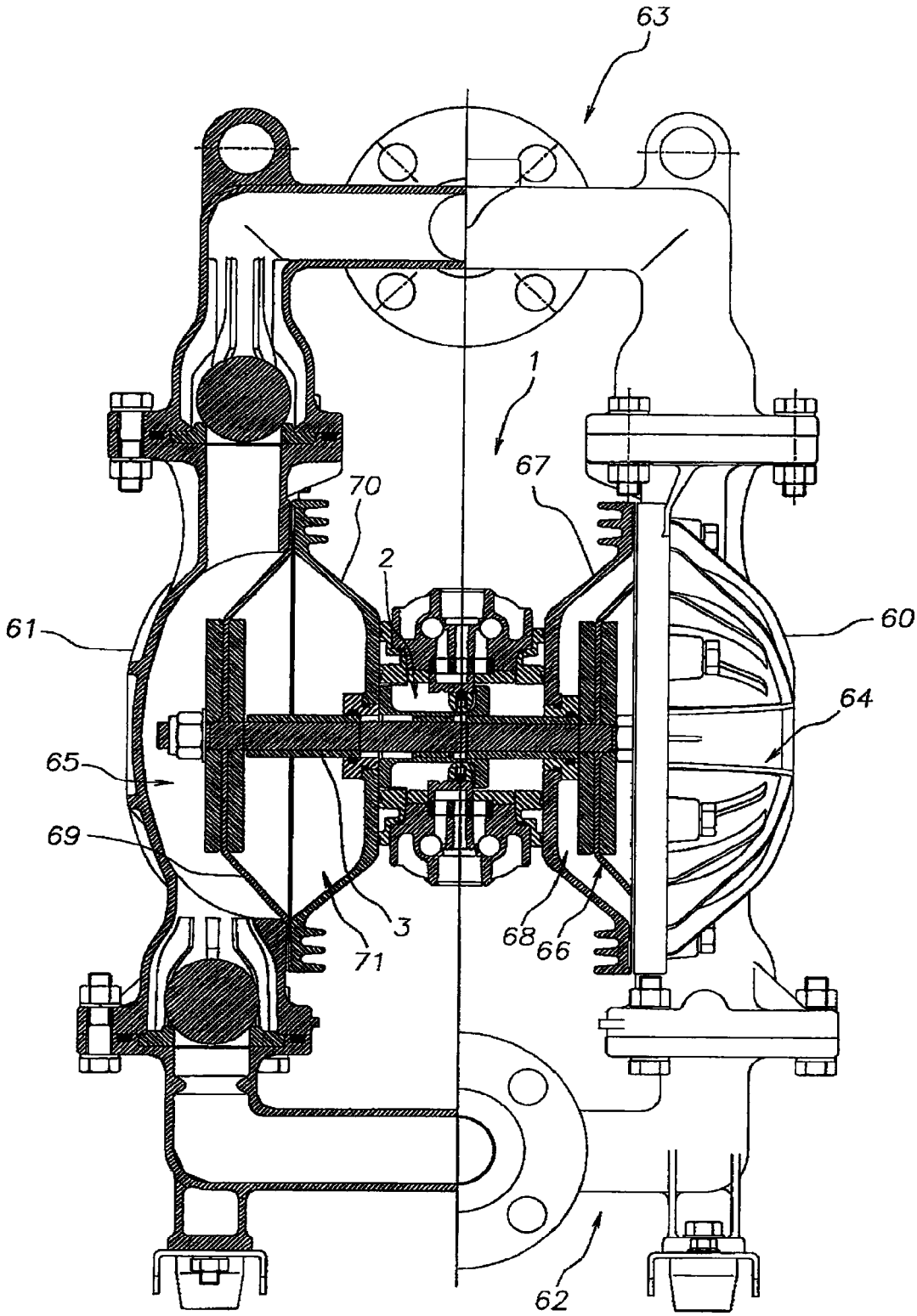
FIG. 1 is a partly sectioned schematic view showing an embodiment of a valve body for pumps according to the present invention in which the valve body is applied to a diaphragm pump.

The best mode for carrying out the valve body for pumps according to the present invention will be explained below with reference to the accompanying drawings. The valve body for pumps according to the present invention is applicable to various pumps such as diaphragm pumps and piston pumps. FIG. 1 shows a valve body 1 for pumps as applied to a double diaphragm pump. As shown in FIG. 1, the valve body 1 is equipped with diaphragm covers 60 and 61. The diaphragm covers 60 and 61 are equipped with an inlet manifold 62 for liquid inflow that has a ball valve and also equipped with an outlet manifold 63 for liquid outflow that also has a ball valve.

The diaphragm covers 60 and 61 form therein diaphragm chambers 64 and 65, respectively. A diaphragm 66 is clamped between the diaphragm cover 60 and a first air chamber block 67 to isolate the diaphragm chamber 64 from a first air chamber 68. Similarly, a diaphragm 69 is clamped between the diaphragm cover 61 and a second air chamber block 70 to isolate the diaphragm chamber 65 from a second air chamber 71.

The two diaphragms 66 and 69 are secured to the opposite ends, respectively, of a center shaft 3 reciprocatably extending (in the horizontal direction in FIG. 2) through a compressed air-filled chamber 2 formed in the center of the valve body 1. The center shaft 3 extends through the first and second air chamber blocks 67 and 70 disposed in symmetry at the opposite sides of the valve body 1 to define the first and second air chambers 68 and 71, respectively. A switching member 72 disposed in the compressed air-filled chamber 2 is attached to the center shaft 3 so as to be slidable together with the center shaft 3 as one unit through switching pins 74.

Figure 2:
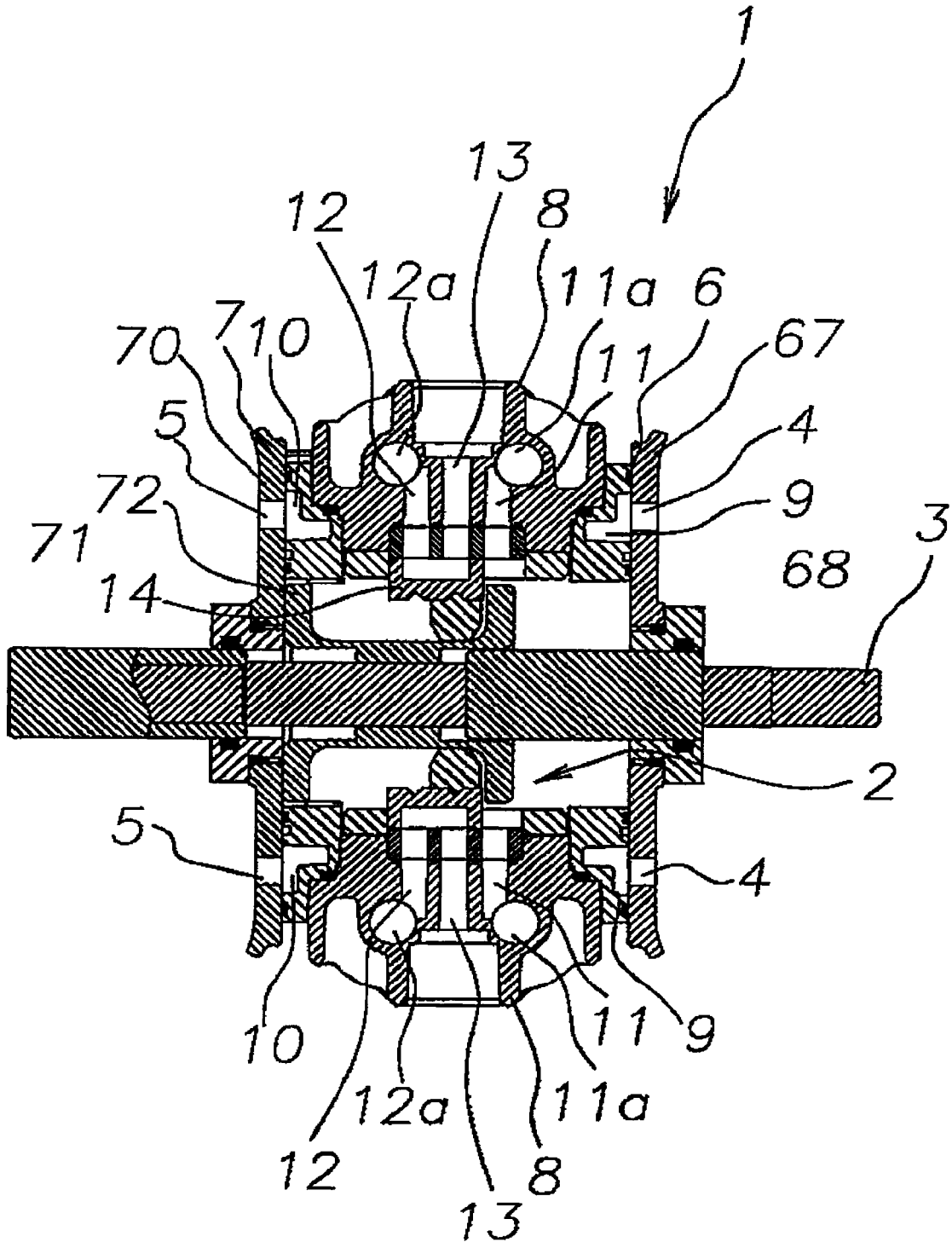
FIG. 2 is a fragmentary enlarged schematic front view showing the embodiment of the valve body shown in FIG. 1.
Figure 3:
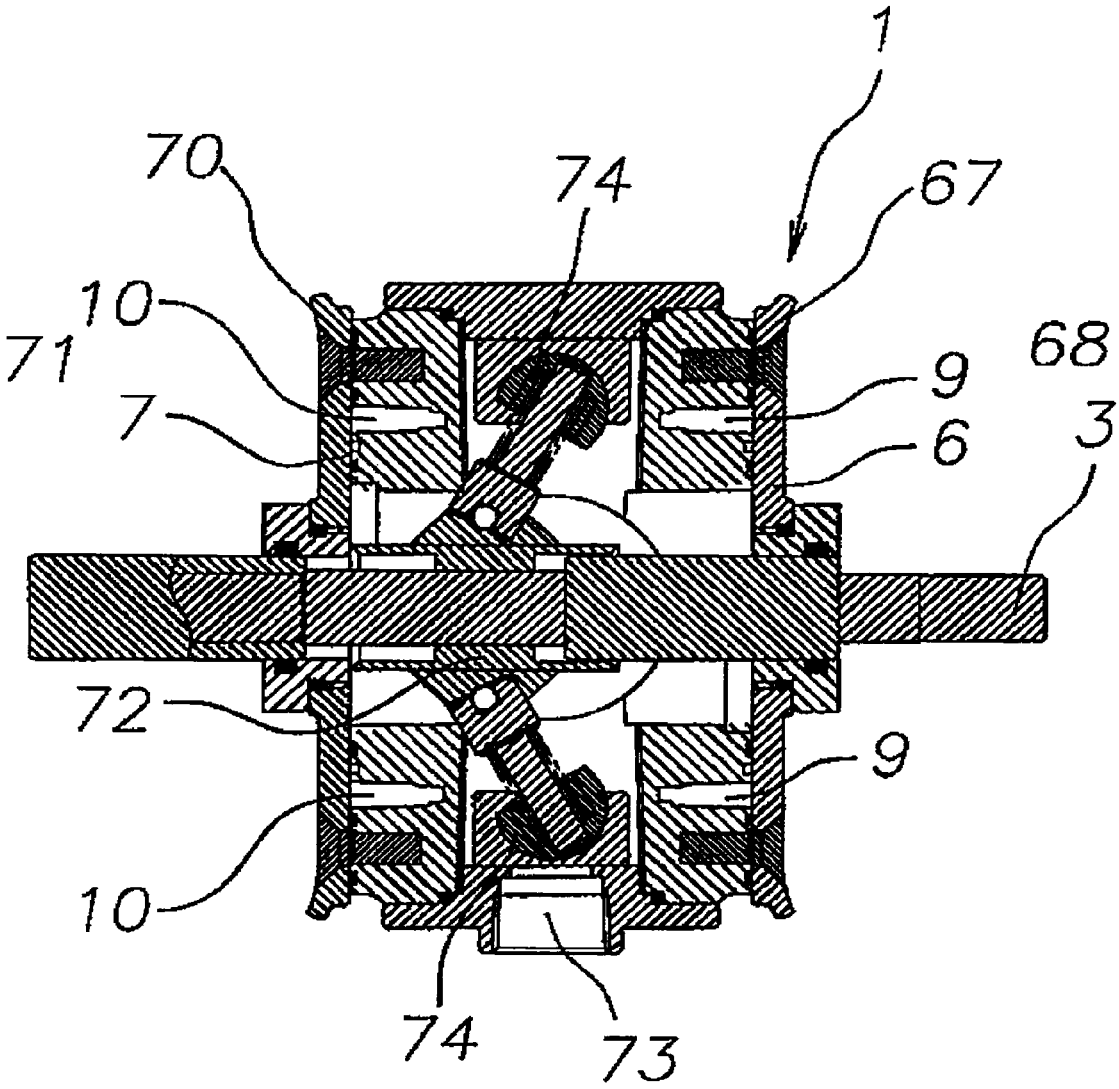
FIG. 3 is a fragmentary enlarged schematic top view showing the embodiment of the valve body shown in FIG. 1.
Figure 7:
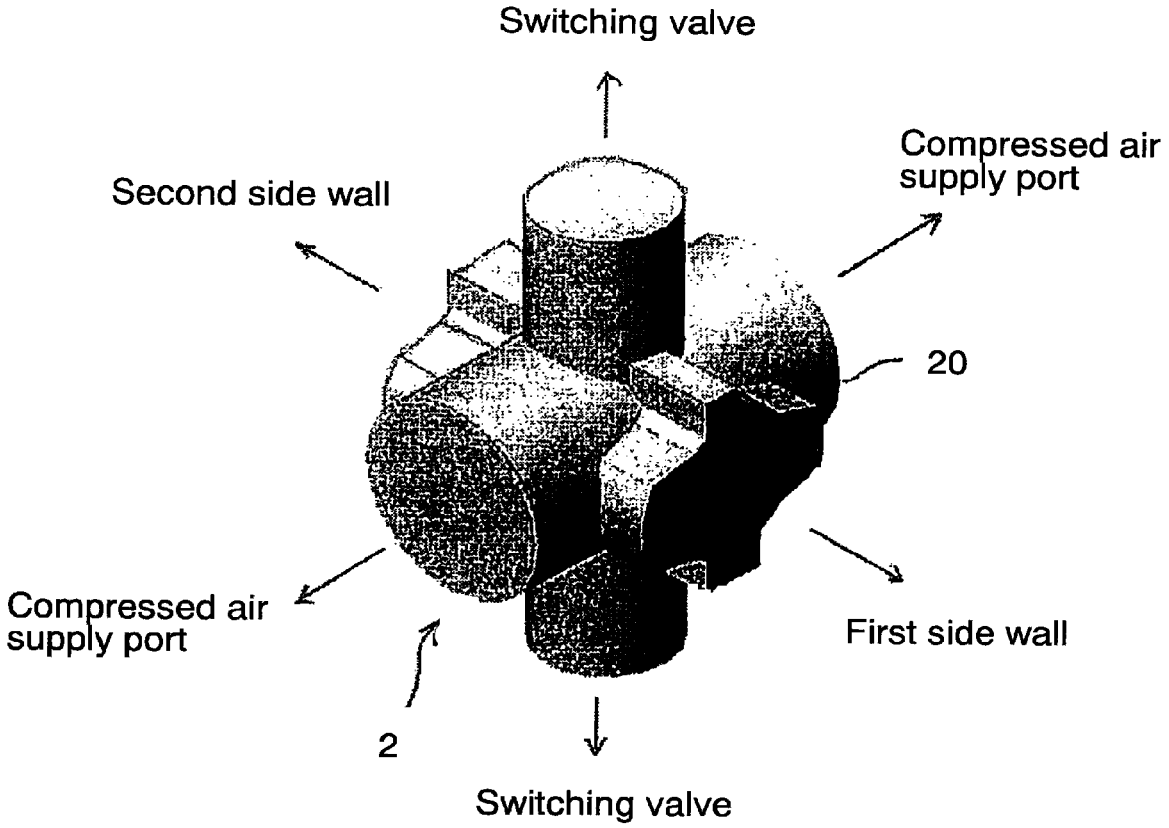
FIG. 7 is a perspective view schematically showing the configuration of the space in a compressed air-filled chamber.
Figure 8:
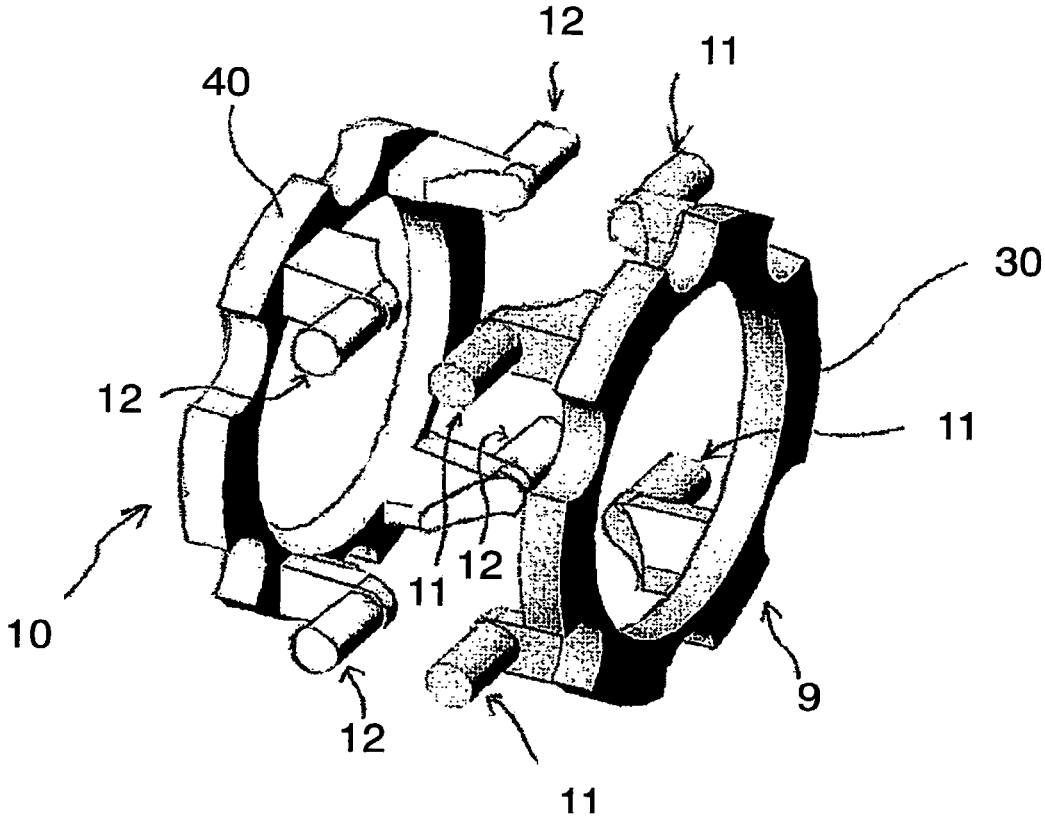
FIG. 8 is a perspective view schematically showing the configuration of the space in an annular groove-shaped first air supply chamber and the configuration of the space in an annular groove-shaped second air supply chamber.

As shown clearly in FIGS. 2 and 3, the valve body 1 has a compressed air supply port 73 through which compressed air is supplied from a supply source (not shown) into the compressed air-filled chamber 2 formed in the center of the valve body 1. The first air chamber block 67 has at least one first through-hole 4 in a side thereof closer to the valve body 1. The second air chamber block 70 has at least one second through-hole 5 in a side thereof closer to the valve body 1. The valve body 1 has a first side wall 6 that is joined to the first air chamber block 67 and a second side wall 7 that is joined to the second air chamber block 70. A large first air supply chamber 9 is formed on the outer surface of the first side wall 6 in the shape of a substantially annular groove so as to communicate with the at least one first through-hole 4 of the first air chamber block 67. Similarly, a large second air supply chamber 10 is formed on the outer surface of the second side wall 7 in the shape of a substantially annular groove so as to communicate with the at least one second through-hole 5 of the second air chamber block 70. The first and second air supply chambers 9 and 10 may be formed in spatial symmetry in the shape of large annular grooves of substantially the same configuration. FIG. 7 schematically shows the configuration of the space 20 in the compressed air-filled chamber 2, and FIG. 8 schematically shows the configuration of the space 30 in the annular groove-shaped first air supply chamber 9 and the configuration of the space 40 in the annular groove-shaped second air supply chamber 10.

Figure 6A:
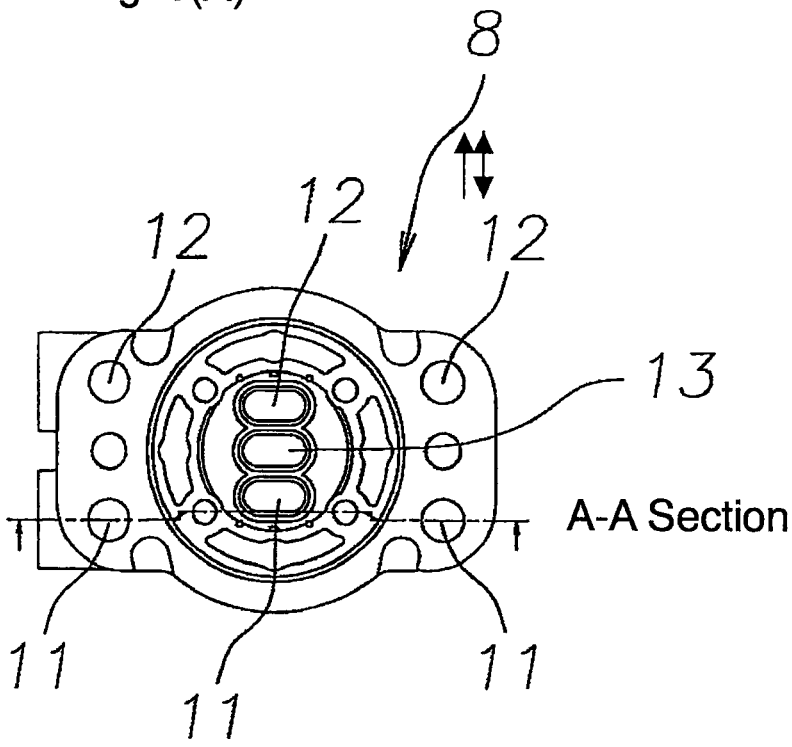
FIG. 6(A) is a bottom view showing an example of a switching valve member applicable to the valve body for pumps according to the present invention.
Figure 6B:
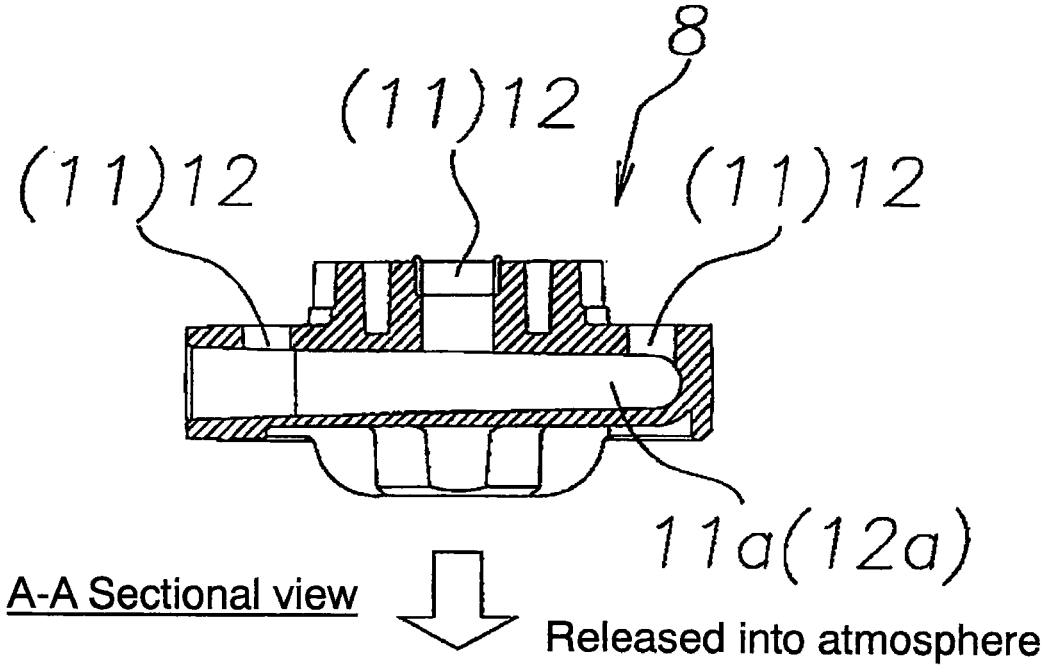
FIG. 6(B) is a sectional view taken along the plane A-A of FIG. 6(A).

The valve body 1 is equipped with a switching valve member 8 shown in FIGS. 2, 6(A) and 6(B). The switching valve member 8 is formed with a first communication passage 11 that communicates between the compressed air-filled chamber 2 and the annular groove-shaped first air supply chamber 9 of the first side wall 6, a second communication passage 12 that communicates between the compressed air-filled chamber 2 and the annular groove-shaped second air supply chamber 10 of the second side wall 7, and an air release passage 13 through which compressed air supplied into the compressed air-filled chamber 2 is released into the atmosphere. The first communication passage 11 is for supplying compressed air supplied into the compressed air-filled chamber 2 of the valve body 1 through the compressed air supply port 73 (see FIG. 3) into the first air chamber 68, which is defined by the first air chamber block 67, through the annular groove-shaped first air supply chamber 9. Similarly, the second communication passage 12 is for supplying compressed air supplied into the compressed air-filled chamber 2 of the valve body 1 through the compressed air supply port 73 (see FIG. 3) into the second air chamber 71, which is defined by the second air chamber block 70, through the annular groove-shaped second air supply chamber 10. A slide member 14 associated with the passages 11, 12 and 13 is disposed in the compressed air-filled chamber 2 in engagement with the switching member 72.

As shown in FIGS. 2, 6(A) and 6(B), the first communication passage 11 is branched into two by a first flow dividing passage 11*a* to communicate with the annular groove-shaped first air supply chamber 9 of the first side wall 6. Similarly, the second communication passage 12 is branched into two by a second flow dividing passage 12*a* to communicate with the annular groove-shaped second air supply chamber 10 of the second side wall 7. Accordingly, the first communication passage 11 and the at least one first through-hole 4 are communicated with each other through the large annular groove-shaped first air supply chamber 9 formed in the first side wall 6, and the second communication passage 12 and the at least one second through-hole 5 are communicated with each other through the large annular groove-shaped second air supply chamber 10 formed in the second side wall 7. Thus, the valve body 1 is configured to have three air spaces, i.e. the space 20 in the compressed air-filled chamber 2 as shown in FIG. 7 and the spaces 30 and 40 in the annular groove-shaped first and second air supply chambers 9 and 10 as shown in FIG. 8. It should be noted that the first and second communication passages 11 and 12 illustrated in the figures may each comprise a plurality of communication passages formed in the switching valve member 8. The first and second communication passages 11 and 12 may each be branched into three or more. Alternatively, the first and second communication passages 11 and 12 may each be formed as a single non-branched communication passage. Although in the illustrated embodiment the switching valve member 8 comprises two switching valves disposed in symmetry with respect to the center shaft 3 in a direction perpendicular to the axial direction of the center shaft 3, the switching valve member 8 may comprise only one switching valve.

Figure 4:
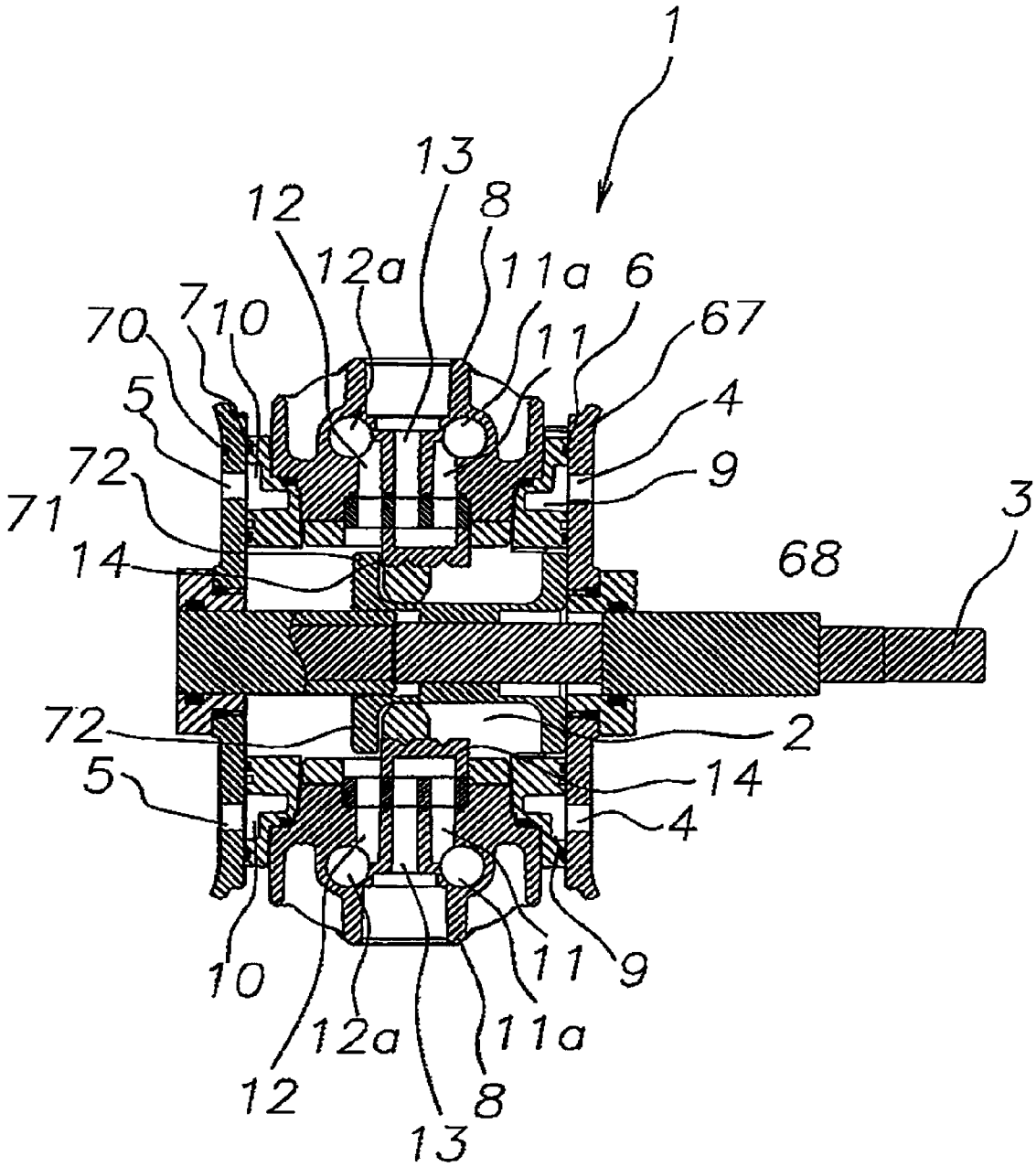
FIG. 4 is another fragmentary enlarged schematic front view showing the embodiment of the valve body shown in FIG. 1.
Figure 5:
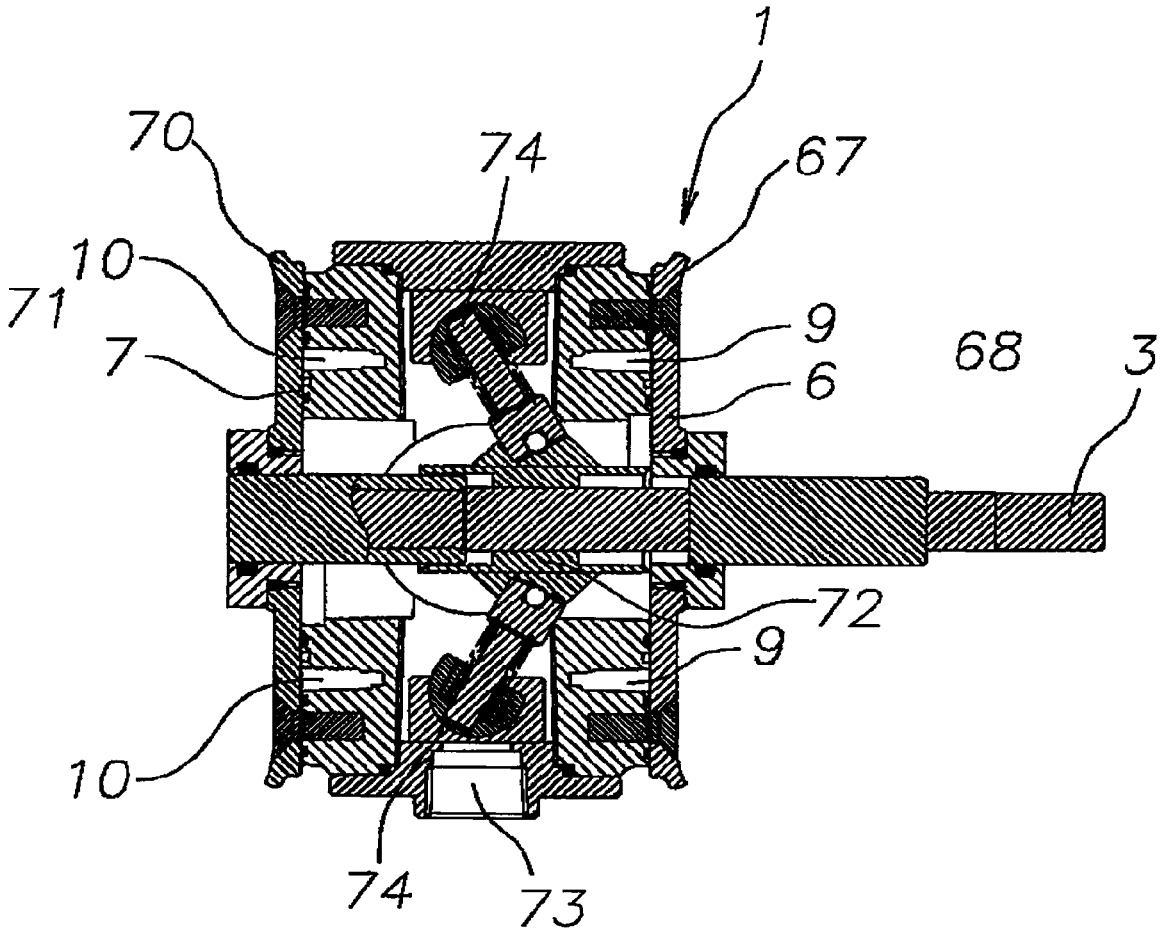
FIG. 5 is another fragmentary enlarged schematic top view showing the embodiment of the valve body shown in FIG. 1.

The operation of the pump will be explained below. In the state shown in FIGS. 2 and 3, the slide member 14 is in a position where it communicates between the second communication passage 12 and the air release passage 13 and the first communication passage 11 communicates between the compressed air-filled chamber 2 and the annular groove-shaped first air supply chamber 9 of the first side wall 6. The compressed air in the second air chamber 71 defined by the second air chamber block 70 is discharged into the atmosphere through the second communication passage 12 and the air release passage 13. When, in this state, compressed air is supplied into the compressed air-filled chamber 2 of the valve body 1 from the compressed air supply port 73, the compressed air passes through the first communication passage 11 and is supplied into the first air chamber 68 via the annular groove-shaped first air supply chamber 9 and through the at least one first through-hole 4 of the first air chamber block 67. The compressed air thus supplied causes the diaphragm 66, which is disposed at the right-hand side in FIG. 1, to move rightward, causing the center shaft 3 to move rightward. The movement of the center shaft 3 causes the slide member 14 to move rightward together with the center shaft 3, thus breaking the communication between the second communication passage 12 and the air release passage 13 and communicating the first communication passage 11 and the air release passage 13 with each other, as shown in FIGS. 4 and 5, to discharge the compressed air in the first air chamber 68, which is defined by the first air chamber block 67, into the atmosphere through the first communication passage 11 and the air release passage 13. When, in this state, compressed air is supplied into the compressed air-filled chamber 2 of the valve body 1 from the compressed air supply port 73, the compressed air passes through the second communication passage 12 and is supplied into the second air chamber 71 via the annular groove-shaped second air supply chamber 10 and through the at least one second through-hole 5 of the second air chamber block 70. The compressed air thus supplied causes the diaphragm 69, which is disposed at the left-hand side in FIG. 1, to move leftward, causing the center shaft 3 to move leftward. The movement of the center shaft 3 causes the slide member 14 to move leftward together with the center shaft 3, thus breaking the communication between the first communication passage 11 and the air release passage 13 and communicating the second communication passage 12 and the air release passage 13 with each other again, as shown in FIGS. 2 and 3. This operation is repeated to perform a pumping action.

Figure 9A:
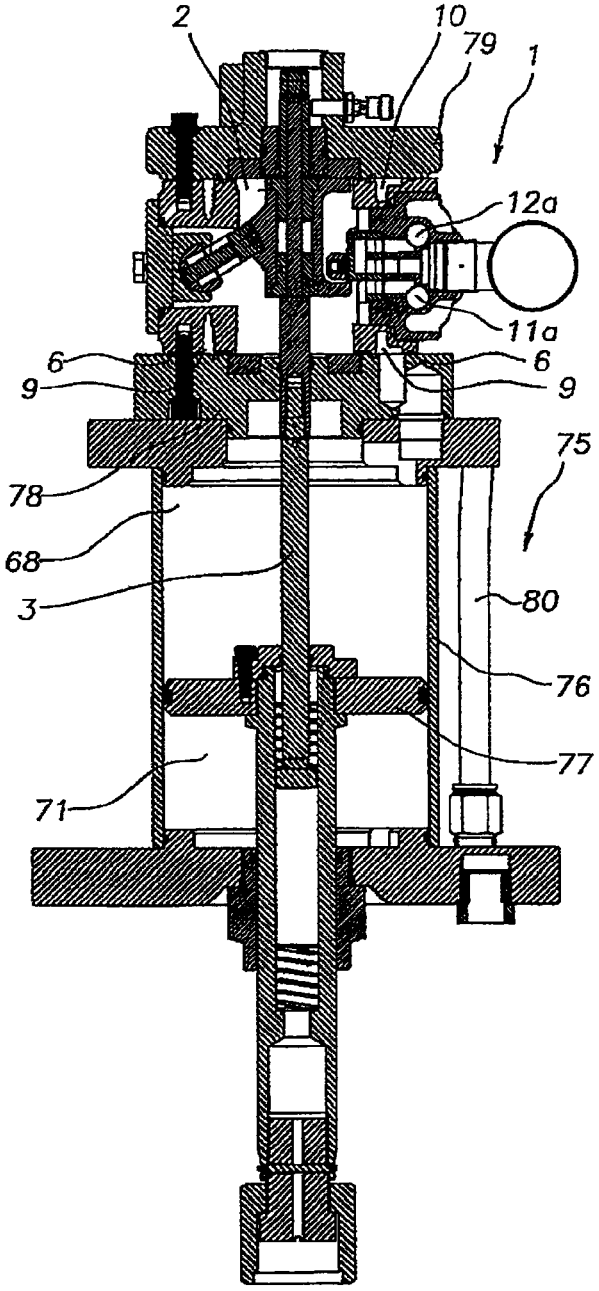
FIG. 9(A) is a partly sectioned schematic view showing an embodiment of a valve body for pumps according to the present invention in which the valve body is installed in an upper part of a piston pump.
Figure 9B:
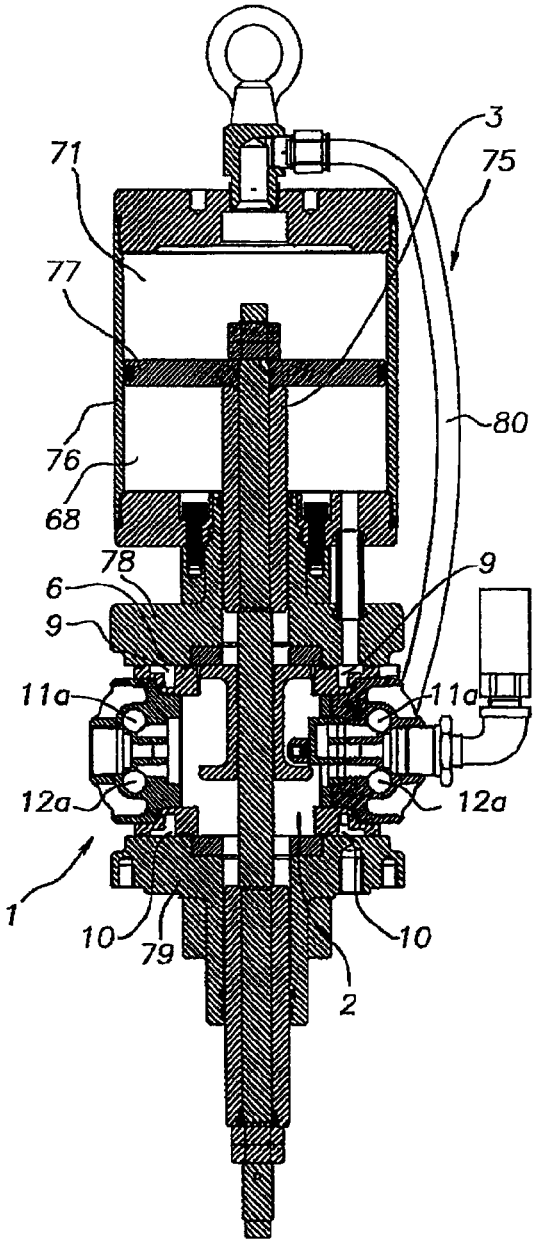
FIG. 9(B) is a partly sectioned schematic view showing an embodiment of a valve body for pumps according to the present invention in which the valve body is installed in a central part of a piston pump.
Figure 10:
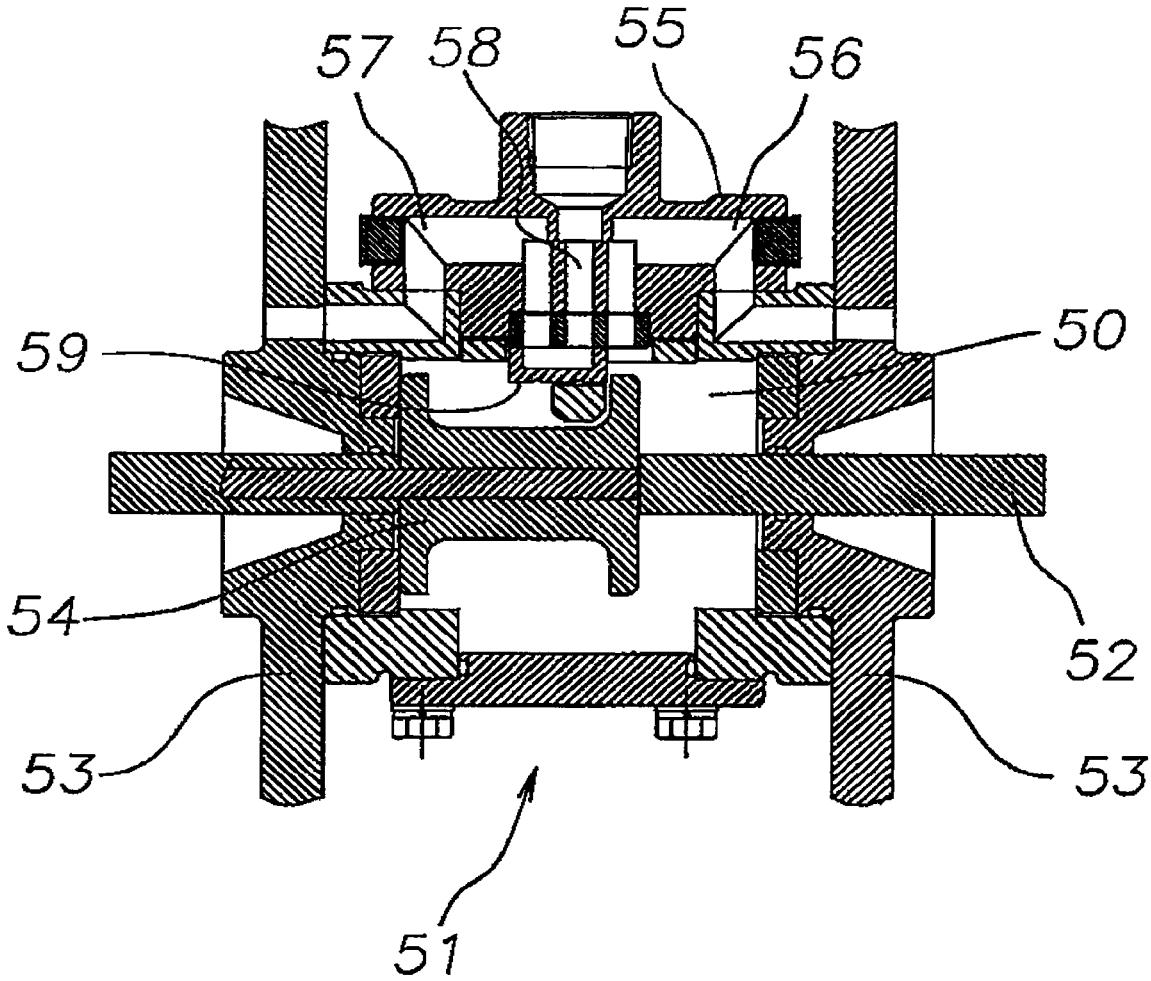
FIG. 10 is a fragmentary enlarged schematic front view showing an example of a conventional valve body for pumps.

Although in the above-described embodiment the valve body 1 for pumps is applied to a diaphragm pump, the valve body 1 may, as shown in FIGS. 9(A) and 9(B), be applied to a piston pump 75 having a piston 77 secured to the center shaft 3 and slidable in a cylinder 76. FIG. 9(A) shows an example in which the valve body 1 is installed in an upper part of a piston pump. FIG. 9(B) shows another example in which the valve body 1 is installed in a central part of a piston pump.

In the examples shown in FIGS. 9(A) and 9(B), one of the pressure chambers isolated from each other by the piston 77 in the cylinder 76 of the piston pump 75 is the first air chamber 68, and the other pressure chamber is the second air chamber 71. A cylinder block 78 serving as a first air chamber block having at least one first through-hole (not shown) is joined to the first side wall 6. The second side wall 7 is secured to a pump cover 79 of the piston pump 75 at the opposite side to the cylinder 76.

The first communication passage 11 communicates with the first air supply chamber 9 in the first side wall 6 through the first flow dividing passage 11*a*, and the first air supply chamber 9 communicates with the at least one first through-hole (not shown) of the cylinder block 78. Accordingly, the first communication passage 11 allows compressed air supplied into the compressed air-filled chamber 2 to be supplied into the first air chamber 68, which is defined by the cylinder block 78, through the first air supply chamber 9. On the other hand, the second communication passage 12 has the second flow dividing passage 12*a* communicated with the second air chamber 71 through a connecting pipe 80. Thus, the second communication passage 12 allows compressed air supplied into the compressed air-filled chamber 2 to be supplied into the second air chamber 71 through the second air supply chamber 10 and the connecting pipe 80. Thus, the valve body 1 for pumps according to the present invention can be applied to a piston pump in the form as applied to a double diaphragm pump. It should be noted that when the valve body 1 for pumps is applied to a piston pump, the second air supply chamber 10 need not necessarily be formed in the valve body 1.

EXPLANATION OF THE REFERENCE NUMERALS

1: valve body for pumps
2: compressed air-filled chamber
3: center shaft
4: first through-hole
5: second through-hole
6: first side wall
7: second side wall
8: switching valve member
9: first air supply chamber
10: second air supply chamber
11: first communication passage
11*a*: first flow dividing passage
12: second communication passage
12*a*: second flow dividing passage
13: air release passage
14: slide member
20: space in compressed air-filled chamber
30: space in first air supply chamber
40: space in second air supply chamber
60: diaphragm cover
61: diaphragm cover
62: inlet manifold for fluid inflow
63: outlet manifold for fluid outflow
64: diaphragm chamber
65: diaphragm chamber
66: diaphragm
67: first air chamber block
68: first air chamber
69: diaphragm
70: second air chamber block
71: second air chamber
72: switching member
73: compressed air supply port
74: switching pin
75: piston pump
76: cylinder
77: piston
78: cylinder block
79: pump cover
80: connecting pipe

What is claimed is:

1. A double diaphragm pump comprising a valve body which comprises:

a compressed air-filled chamber in a center of the valve body;

a compressed air supply port through which compressed air is supplied into said compressed air-filled chamber;

a first side wall joined to a first air chamber block that defines a first air chamber and that has at least one first through-hole;

a first communication passage communicating between said compressed air-filled chamber and said first side wall;

a second side wall joined to a second air chamber block that defines a second air chamber and that has at least one second through-hole;

a second communication passage communicating between said compressed air-filled chamber and said second side wall;

an annular groove-shaped first air supply chamber formed in said first side wall, said first communication passage and said at least one first through-hole being communicated with each other through said annular groove-shaped first air supply chamber;

an annular groove-shaped second air supply chamber formed in said second side wall, said second communication passage and said at least one second through-hole being communicated with each other through said annular groove-shaped second air supply chamber.

2. The double diaphragm pump of claim 1, wherein said first air supply chamber and said second air supply chamber are formed in substantially the same annular groove shape.

3. The double diaphragm pump of claim 1, wherein said first communication passage and said second communication passage each comprise a plurality of communication passages.

4. A piston pump comprising a valve body which comprises:

a compressed air-filled chamber in a center of the valve body;

a compressed air supply port through which compressed air is supplied into said compressed air-filled chamber;

a first side wall joined to a first air chamber block that defines a first air chamber and that has at least one first through-hole;

a first communication passage communicating between said compressed air-filled chamber and said first side wall;

a second side wall joined to a second air chamber block that defines a second air chamber and that has at least one second through-hole;

a second communication passage communicating between said compressed air-filled chamber and said second side wall;

an annular groove-shaped first air supply chamber formed in said first side wall, said first communication passage and said at least one first through-hole being communicated with each other through said annular groove-shaped first air supply chamber; and an annular groove-shaped second air supply chamber formed in said second side wall, said second communication passage and said at least one second through-hole being communicated with each other through said annular groove-shaped second air supply chamber.

5. The piston pump of claim 4, wherein said first air supply chamber and said second air supply chamber are formed in substantially the same annular groove shape.

6. The piston pump of claim 4, wherein said first communication passage and said second communication passage each comprise a plurality of communication passages.

* * * * *